United States Patent [19]

Katogi

[11] Patent Number: 5,032,094

[45] Date of Patent: Jul. 16, 1991

[54] TILT-TRIM SYSTEM FOR OUTBOARD MOTORS

[75] Inventor: Sadaji Katogi, Saitama, Japan

[73] Assignee: Kabushiki Kaisha Showa Seisakusho, Tokyo, Japan

[21] Appl. No.: 413,545

[22] Filed: Sep. 27, 1989

[30] Foreign Application Priority Data

Oct. 5, 1988 [JP] Japan ..... 63-251471

[51] Int. Cl.[5] ..... B63H 5/12

[52] U.S. Cl. ..... 440/61; 440/900; 440/53

[58] Field of Search ..... 440/53, 61, 63, 900; 248/640–643; 91/508, 509

[56] References Cited

U.S. PATENT DOCUMENTS 3,839,986 10/1974 Meyer et al. ..... 440/61
4,391,592 7/1983 Hundertmark ..... 440/61
4,557,696 12/1985 Nakahama ..... 440/61
4,786,263 11/1988 Burmeister et al. ..... 440/61 X

FOREIGN PATENT DOCUMENTS 0097491 4/1988 Japan ..... 440/61
0121597 5/1988 Japan ..... 440/61

*Primary Examiner*—Ed Swinehart
*Attorney, Agent, or Firm*—Rosen, Dainow & Jacobs

[57] ABSTRACT

A tilt-trim system for tilting and trimming an outboard propulsion unit on a boat includes a unitary cylinder unit assembly including a tilt cylinder unit and a trim cylinder unit, a stern bracket adapted to be mounted on the transom of the boat, a swivel bracket for supporting the outboard propulsion unit, the swivel bracket being pivotally supported on an upper end of the stern bracket, and a hydraulic pressure circuit for actuating the tilt cylinder unit and the trim cylinder unit. The cylinder unit assembly has an upper end pivotally supported on the stern bracket and a lower end pivotally supported on the swivel bracket.

7 Claims, 3 Drawing Sheets

TILT-TRIM SYSTEM FOR OUTBOARD MOTORS

BACKGROUND OF THE INVENTION

1. Field of the Invention

The present invention relates to a tilt-trim system for use with an outboard motor to be mounted on a boat.

2. Description of the Relevant Art

Small ships such as motor boats or the like are associated with a tilt-trim system. The tilt-trim system comprises a tilt cylinder unit for swinging a swivel bracket through a large angle to lift the lower portion of the outboard motor above the water level or lower below the water level, and a trim cylinder unit for angularly moving the swivel bracket through a relatively small angle to trim the outboard motor while the lower portion thereof is being submerged.

According to the general tilt-trim system design, two trim cylinder units are disposed one on each side of a single tilt cylinder unit. The tilt cylinder unit has a piston rod pivotally supported on a swivel bracket through an upper shaft, and a cylinder pivotally supported by an under shaft on a stern bracket attached to the boat. The trim cylinders, which are separate from the tilt cylinder, are mounted on the stern bracket. A manifold containing a hydraulic pressure pump is mounted on one of the trim cylinders, and a motor for actuating the hydraulic pressure pump is mounted on the manifold. The manifold and the tilt cylinder are connected to each other by external lower and upper pipes.

Since the tilt and trim cylinders are separate from each other and the manifold is integrally mounted on one of the trim cylinders, at least two hydraulic pressure pipes, i.e., the lower and upper pipes, for interconnecting the manifold and the tilt cylinder have to be installed exteriorly on the manifold and the tilt cylinder. However, inasmuch the tilt cylinder is swung when the outboard motor is tilted upwardly and downwardly, the hydraulic pressure pipes are fatigued due to repeated bending, and tend to rust owing to galvanic corrosion. The manifold is subjected to shocks through the under shaft and the tilt cylinder when the outboard motor is hit underwater by foreign matter such as driftwood. Consequently, the manifold must be mechanically strong enough to withstand such shocks, and hence is large and heavy.

SUMMARY OF THE INVENTION

According to the present invention, there is provided a tilt-trim system for use with an outboard propulsion unit on a boat having a transom, comprising a unitary cylinder unit assembly including a tilt cylinder unit and a trim cylinder unit, a stern bracket adapted to be mounted on the transom of the boat, the cylinder unit assembly having an upper end pivotally supported on the stern bracket, a swivel bracket for supporting the outboard propulsion unit, the swivel bracket being pivotally supported on an upper end of the stern bracket, the cylinder unit assembly having an upper end pivotally supported on the swivel bracket, and a hydraulic pressure circuit for actuating the tilt cylinder unit and the trim cylinder unit.

The above and further objects, details and advantages of the present invention will become apparent from the following detailed description of a preferred embodiment thereof, when read in conjunction with the accompanying drawings.

DETAILED DESCRIPTION OF THE PREFERRED EMBODIMENT

Figure 1:
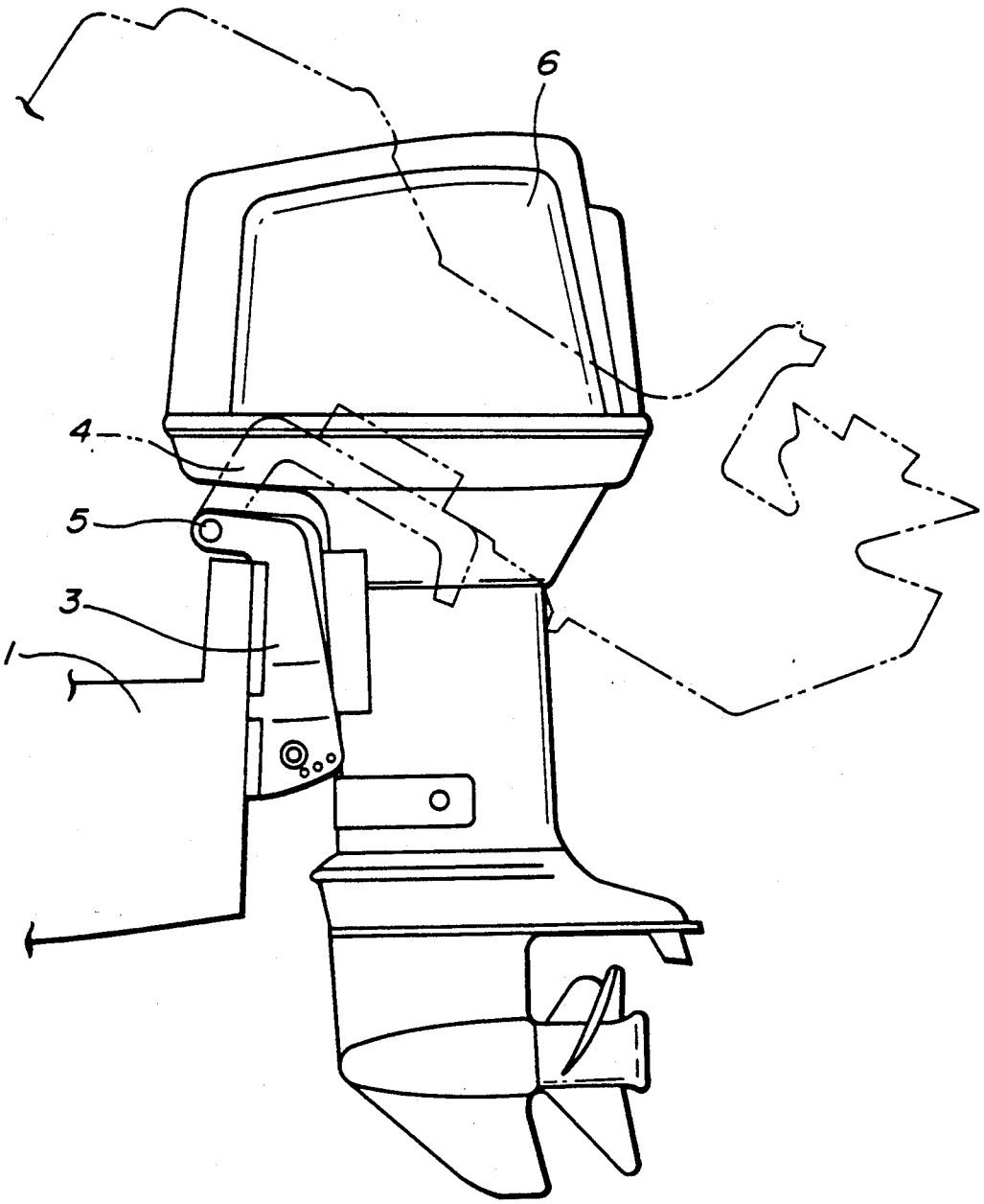
FIG. 1 is a side elevational view of a tilt-trim system according to the present invention which is mounted on the transom of a boat and an outboard motor supported on the tilt-trim system.
Figure 2:
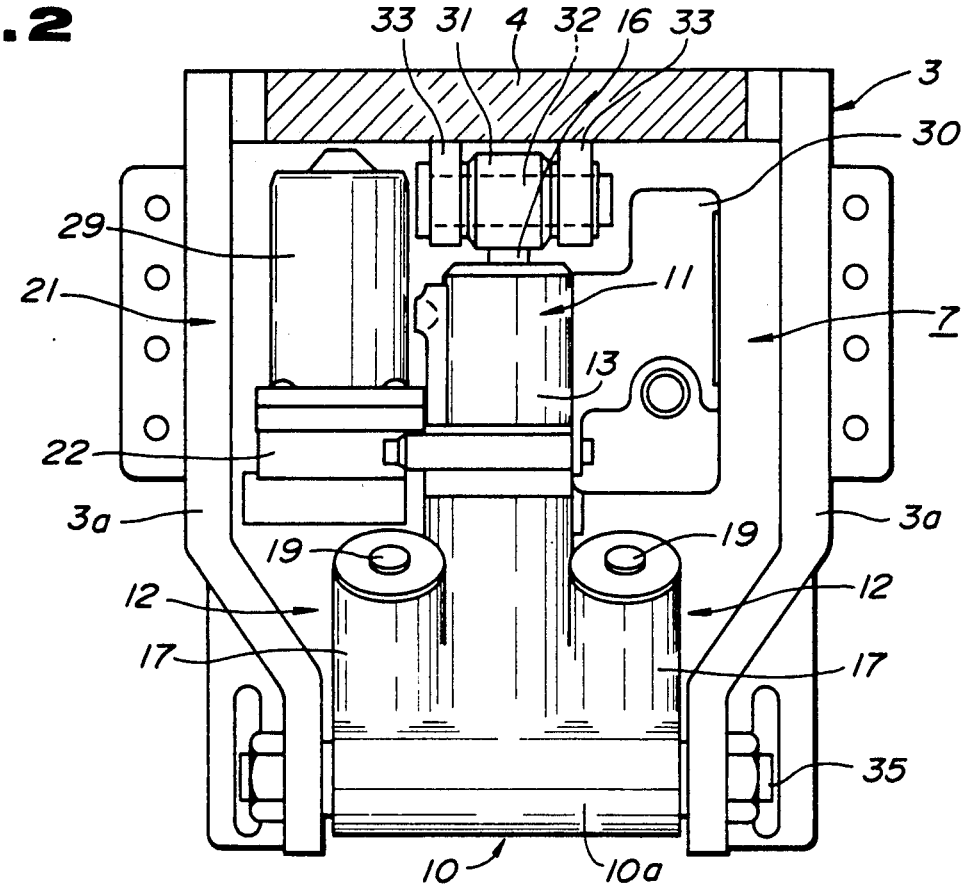
FIG. 2 is a front elevational view, partly in cross section, of the tilt-trim system shown in FIG. 1.
Figure 3:
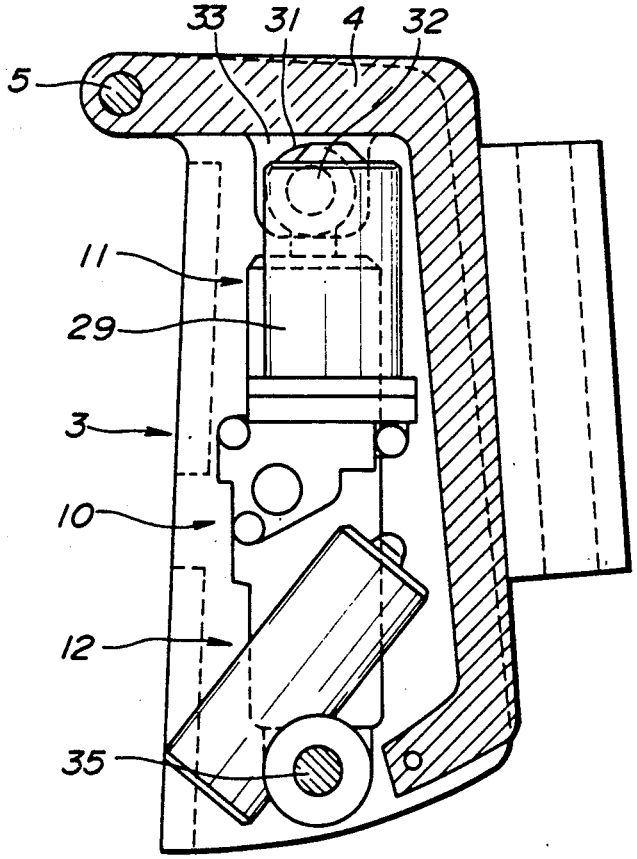
FIG. 3 is a side elevational view, partly in cross section, of the tilt-trim system shown in FIG. 1.

As shown in FIG. 2, a stern bracket 3 has a pair of side plates 3*a* parallel to each other. The stern bracket 3 is mounted on a transom of a boat 1, as shown in FIG. 1, such that the side plates 3*a* are spaced transversely of the boat 1. A swivel bracket 4 on which an outboard motor 6 is mounted is pivotally supported on the upper end of the stern bracket 3 by means of a shaft 5. The swivel bracket 4 is swingable with the outboard motor 6 up to a position indicated by the two-dot-and-dash lines in FIG. 1. A tilt-trim system 7 (FIG. 2) according to the present invention is disposed between the side plates 3*a* of the stern bracket 3. The swivel bracket 4 can be angularly moved with respect to the stern bracket 3 by the tilt-trim system 7 to tilt the lower portion of the outboard motor 6 into and out of the water. While the lower portion of the outboard motor 6 is being submerged, the outboard motor 6 can be trimmed by the tilt-trim system 7.

The tilt-trim system 7 has a cylinder unit assembly 10 including a central tilt cylinder unit 11 and a pair of trim cylinder units 12 disposed one on each side of the tilt cylinder unit 11.

Figure 4:
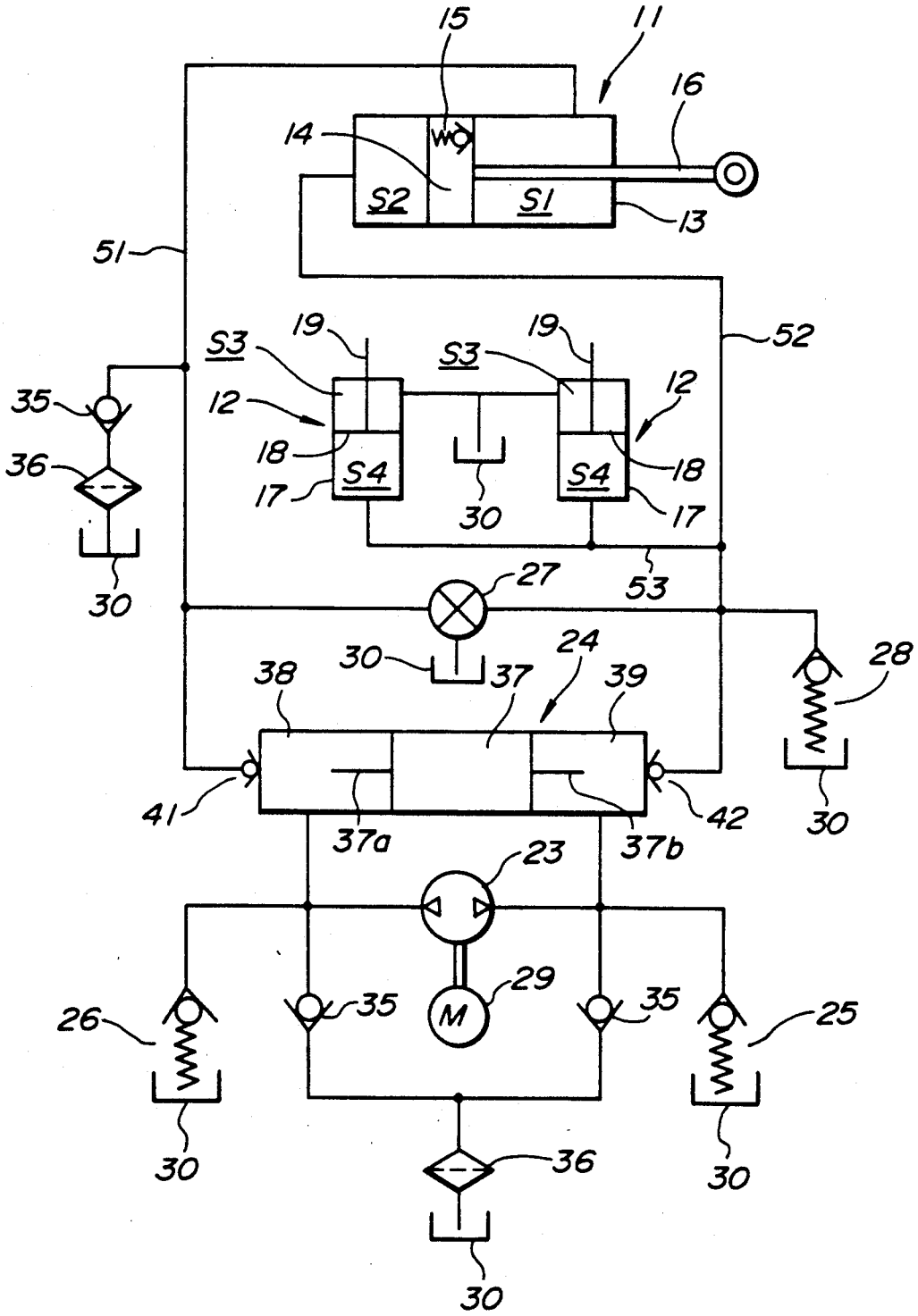
FIG. 4 is a circuit diagram showing a hydraulic pressure circuit coupled to the tilt-trim system.

As shown in FIG. 4, the tilt cylinder unit 11 comprises a tilt cylinder 13, a piston 14 slidably fitted in the tilt cylinder 13, and a tilt rod 16 connected to the piston 14. The interior space of the tilt cylinder 13 is divided into an upper chamber S1 and a lower chamber S2 by the piston 14. The piston 14 has a one-way valve 15 disposed therein.

Each of the trim cylinder units 12 comprises a trim cylinder 17, a piston 18 slidably fitted in the trim cylinder 17, and a trim rod 19 connected to the piston 18 and engagable with the swivel bracket 4. The interior space of the trim cylinder 17 is divided into an upper chamber S3 and a lower chamber S4 by the piston 18.

The tilt cylinder 13 of the tilt cylinder unit 11 and the trim cylinders 17 of the trim cylinder units 12 are of an integral cast construction. The integral cast construction of the cylinder unit assembly 10 increases the rigidity of the lower portion of the tilt-trim system 7 for greater mechanical strength against shocks. The tilt cylinder 13 and the trim cylinders 17 may be separately manufactured and subsequently assembled together.

A motor-pump unit 21 and a tank 30 are disposed one on each side of the tilt cylinder 13 and mounted on an outer peripheral surface of the tilt cylinder 13. The motor-pump unit 21 comprises a manifold 22 and a motor 29 mounted on an outer surface of the manifold 22. The manifold 22 houses therein a hydraulic pressure pump 23, a shuttle valve 24, an upblow valve 25, a downblow valve 26, a manual valve 27, a thermal valve 28, and hydraulic pressure passages interconnecting these devices, as shown in FIG. 4. The motor 29 serves to drive the hydraulic pressure pump 23.

A short tubular joint 31 is attached to the tip of the tilt rod 16 of the tilt cylinder unit 11. Through the tubular joint 31, there extends an upper shaft 32 supported by a pair of support members 33 which depends from the lower surface of the swivel bracket 4. Thus, the upper end of the cylinder unit assembly 10 is pivotally supported by the swivel bracket 4.

A long tubular joint 10*a* is positioned at the bottom of the cylinder unit assembly 10. An under shaft 35 supported between the side plates 3*a* of the stern bracket 3 is inserted through the tubular joint 10*a*, so that the lower end of the cylinder unit assembly 10 is swingably supported by the stern bracket 3.

A hydraulic pressure circuit for operating the tilt cylinder unit 11 and the trim cylinder units 12 will be described below with reference to FIG. 4.

The pump 23 driven by the motor 29 has two inlet and outlet ports connected to the tank 30 through a check valve 35 and a filter 36, and also to lefthand and righthand chambers 38, 39 defined in the shuttle valve 24 by a spool 37 therein. The spool 37 has a pair of axial rods 37*a*, 37*b* on its opposite ends, respectively. The lefthand chamber 38 of the shuttle valve 24, which serves as an up/down selector valve, is joined through a check valve 41 to the upper chamber S1 of the tilt cylinder 13. The righthand chamber 39 of the up/down selector valve 24 is joined through a check valve 42 to the lower chamber S2 of the tilt cylinder 13 and also to the lower chambers S4 of the trim cylinders 17. The check valves 41, 42 can be opened by the rods 37*a*, 37*b*, respectively, of the spool 37. The upper chambers S3 of the trim cylinders 17 are connected to the tank 30. The manual valve 27 serves to return working oil from the upper chamber S1 of the tilt cylinder 13 and the lower chambers S4 of the trim cylinders 17 when the lower portion of the outboard motor 6 is manually lifted.

The shuttle valve 24, the tilt cylinder 13, and the trim cylinder 17 are held in communication with each other by means of hydraulic pressure passages 51, 52, 53 which are defined in the cylinder unit assembly 10. The hydraulic pressure passages 51, 52, 53 may be defined by pipes which are embedded when the tilt cylinder 13 and the trim cylinders 17 are integrally formed, or may be defined by machining the cylinder unit assembly 10 after it has been formed.

The tilt-trim system 7 thus constructed operates as follows:

To swing the swivel bracket 4 to lift the lower portion of the outboard motor 6, the motor 29 is energized to actuate the pump 23 to draw working oil from the tank 30 and supply it under pressure into the righthand chamber 39 of the shuttle valve 24. The pressure buildup in the righthand chamber 39 opens the check valve 42, and also moves the spool 37 to the left in FIG. 4, thus opening the check valve 41 with the rod 37*a*. Therefore, the working oil from the pump 23 flows into the lower chamber S2 of the tilt cylinder 13 and also into the lower chambers S4 of the trim cylinders 17 through the check valve 42 of the shuttle valve 24. The working oil in the upper chamber S1 of the tilt cylinder 13 returns through the check valve 41 of the shuttle valve 24 back to the inlet port of the pump 23. The piston 14 of the tilt cylinder unit 11 and the pistons 18 of the trim cylinder units 12 are elevated to extend the tilt rod 16 and the trim rods 19, so that the swivel bracket 4 is swung upwardly to elevate the lower portion of the outboard motor 6.

To lower the lower portion of the outboard motor 6, the motor 29 is reversed to actuate the pump 23 in the opposite direction to draw working oil from the tank 30 and supply it under pressure to the left chamber 38 of the shuttle valve 24. Under the pressure buildup in the left chamber 38, the check valve 41 is opened, and the spool 37 is moved to the right, opening the check valve 42 with the rod 37*b*. Therefore, the working oil from the pump 23 flows through the check valve 41 into the upper chamber S1 of the tilt cylinder 13, and the working oil in the lower chamber S2 of the tilt cylinder 13 and the working oil in the lower chambers S4 of the trim cylinders 17 return through the check valve 42 back to the inlet port of the pump 23. Consequently, the piston 14 of the tilt cylinder unit 11 and the pistons 18 of the trim cylinder units 12 are lowered to withdraw the tilt rod 16 and the trim rods 19. The swivel bracket 4 is swung downwardly to lower the lower portion of the outboard motor 6.

When the tilt cylinder unit 11 and the trim cylinder units 12 are operated, i.e., when the swivel bracket 4 is swung, the tilt cylinder unit 11 and the trim cylinder units 12 are swung in unison with each other. Since the manifold 22 is mounted on the tilt cylinder unit 11, shocks acting on the outboard motor 6 are not directly transmitted to the manifold 22, which can therefore be small in size and lightweight.

With the present invention, as described above, inasmuch as the tilt cylinder and the trim cylinders are of a unitary structure and angularly movable in unison relatively to the stern bracket, working oil flow paths interconnecting the manifold, the tilt cylinder, and the trim cylinders may be defined without employing exteriorly installed pipes, and hence no pipe damage and corrosion problems occur. The tilt-trim system is constructed as a single assembly with the hydraulic pressure circuit incorporated in the unitary cylinder unit assembly. Therefore, the tilt-trim system can easily be attached to and detached from the stern bracket and the swivel bracket. The lower end of the cylinder unit assembly is pivotally supported on the stern bracket through the unitary joint, so that the lower portion of the cylinder unit assembly is of high rigidity. The cylinder unit assembly is therefore of increased mechanical strength against shocks produced when the outboard motor is hit by driftwood, and also is lightweight.

Although there has been described what is at present considered to be the preferred embodiment of the present invention, it will be understood that the invention may be embodied in other specific forms without departing from the essential characteristics thereof. The present embodiment is therefore to be considered in all aspects as illustrative, and not restrictive. The scope of the invention is indicated by the appended claims rather than by the foregoing description.

I claim:

1. A tilt-trim system for use with an outboard propulsion unit on a boat having a transom, comprising:

a stern bracket adapted to be mounted on the transom of the boat;

a swivel bracket for supporting the outboard propulsion unit, said swivel bracket being pivotally supported on an upper end of said stern bracket;

a cylinder unit assembly including a tilt cylinder unit having a lower end pivotally supported on said stern bracket and an upper end pivotally supported on said swivel bracket, and a trim cylinder unit fixed to said tilt cylinder unit and swingable in unison with said tilt cylinder unit with respect to said stern bracket, said trim cylinder unit having a trim piston rod extending toward said swivel bracket and engageable therewith when said swivel bracket is in a trim range and being spaced therefrom when said swivel bracket is in a tilt range extending upwardly from the trim range; and a hydraulic pressure circuit for actuating said tilt cylinder unit and said trim cylinder unit.

2. A tilt-trim system according to claim 1, wherein said tilt cylinder unit has a cylinder and said trim cylinder unit has a cylinder, said cylinders being of integral cast construction.

3. A tilt-trim system according to claim 1, wherein said hydraulic pressure circuit includes a motor-pump unit and a tank for supplying and storing working oil, said motor pump unit and said tank being separately mounted on an outer peripheral surface of said tilt cylinder unit.

4. A tilt-trim system according to claim 3, wherein said motor-pump unit comprises a manifold mounted on said cylinder unit assembly and housing an oil pump and valves, and a motor for actuating said oil pump, said motor being mounted on said manifold.

5. A tilt-trim system according to claim 4, wherein said manifold, said tilt cylinder, and said trim cylinder are held in communication with each other by hydraulic pressure passages, said hydraulic pressure passages being defined in said cylinder unit assembly when said tilt cylinder and said trim cylinder are integrally formed with each other.

6. A tilt-trim system according to claim 3, wherein said motor-pump unit and said tank are disposed at opposite sides of said tilt cylinder unit.

7. A marine propulsion device comprising:

a transom bracket adapted to be mounted on a boat transom;

a swivel bracket supported from said transom bracket for pivotal movement about a horizontal axis and through a trim range and a tilt range extending upwardly from the trim range;

a hydraulic tilt and trim assembly comprising a tilt hydraulic cylinder/piston assembly comprising a tilt cylinder pivotally connected to one of said swivel bracket and said transom bracket and a tilt piston rod pivotally connected to the other of said swivel bracket and said transom bracket, and a trim hydraulic cylinder/piston assembly comprising a trim cylinder fixed to said tilt cylinder for common movement therewith and a trim piston rod extending toward said swivel bracket and engageable therewith when said swivel bracket is in the trim range and being spaced therefrom when said swivel bracket is in said tilt range, and a propulsion unit supported by said swivel bracket for common movement therewith about said horizontal axis and for pivotal movement relative to said swivel bracket about an axis transverse to said horizontal axis and including a propeller assembly.

* * * * *